United States Patent [19]

Makowski et al.

[11] Patent Number: 4,804,330

[45] Date of Patent: Feb. 14, 1989

[54] HERMETIC, VACUUM AND PRESSURE TIGHT ELECTRICAL FEEDTHRU

[75] Inventors: Maciej J. Makowski, Santa Ynez; Frank M. Boyd, Saugus, both of Calif.

[73] Assignee: The United States of America as represented by the Secretary of the Air Force, Washington, D.C.

[21] Appl. No.: 49,380

[22] Filed: May 14, 1987

[51] Int. Cl.[4] ..... H01R 9/09

[52] U.S. Cl. ..... 439/76; 174/18; 439/65; 439/283

[58] Field of Search ..... 174/18, 151; 439/76–78, 65, 83, 283

[56] References Cited

U.S. PATENT DOCUMENTS

| | | | |
|---|---|---|---|
| 2,932,810 | 4/1960 | Novak | 339/17 |
| 3,267,314 | 8/1966 | Williams et al. | 313/49 |
| 3,471,826 | 10/1969 | Hutter et al. | 439/283 |
| 3,764,730 | 10/1973 | Malone et al. | 174/151 |
| 4,125,310 | 11/1978 | Reardon, II et al. | 339/92 M |
| 4,398,780 | 8/1983 | Novotny et al. | 339/49 R |
| 4,453,795 | 6/1984 | Moulin | 339/92 M |
| 4,467,237 | 8/1984 | Piaget et al. | 439/65 |
| 4,526,432 | 7/1985 | Cronin et al. | 339/75 M |
| 4,560,232 | 12/1985 | O'Hara | 339/268 R |
| 4,618,197 | 10/1986 | White | 439/76 |
| 4,723,196 | 2/1988 | Hofmeister et al. | 439/76 |

FOREIGN PATENT DOCUMENTS

| | | | |
|---|---|---|---|
| 0663011 | 5/1979 | U.S.S.R. | 174/151 |

*Primary Examiner*—Gil Weidenfeld
*Assistant Examiner*—Paula A. Austin
*Attorney, Agent, or Firm*—William G. Auton; Donald J. Singer

[57] ABSTRACT

A vacuum tight electrical feedthru is disclosed for use where electrical leads must pass through the walls of a container in which a high vacuum must be maintained. It is useful in conjunction with infrared sensors, as well as for security, fire detection, rescue, night vision and medical applications. The feedthru includes a ceramic circuit ring with electrical traces deposited on one side. A ceramic seal ring partially covers the traces and is fired down to the main ceramic ring forming a hermetic seal. Metal rings are brazed to the seal ring and the ceramic circuit ring to allow welding to a housing. Spring loaded pads load a resilient pad onto the cables forcing gold plated dots to make contact to the pads on the ceramic circuit ring. This feedthru provides 180 conductors, 90 on each side. The ribbon cables are etched to expose the wires, which are then pressed on the gold dots.

7 Claims, 4 Drawing Sheets

HERMETIC, VACUUM AND PRESSURE TIGHT ELECTRICAL FEEDTHRU

The invention described herein may be manufactured and used by or for the Government for governmental purposes without the payment of any royalty thereon.

BACKGROUND OF THE INVENTION

The present invention relates generally to electrical connectors, and more specifically to a vacuum tight electrical feedthru where electrical leads pass through the walls of a container in which a high vacuum must be maintained.

A variety of electrical and optical systems are designed to use vessels that maintain a pressure differential between the inside and the outside of the vessel. These systems include lasers and charge coupled device (CCD) arrays which are vacuum cavities as well as systems with pressurized containers.

It is a generally recognized problem in the art that vessels subjected to such significant pressure differentials often need elecctrical feedthru connections between the inside and the outside. Such feedthru connections can cause leaks and hazards in the operation of such vessels.

The task of providing an electrical feedthru for pressurized and vacuum tight vessels is alleviated, to some extent, by the systems presented in the following U.S. Patents, the disclosures of which are incorporated herein by reference:

U.S. Pat. No. 2,932,810 issued to Novak;
p U.S. Pat. No. 3,267,314 issued to Williams et al,
U.S. Pat. No. 4,125,310 issued to Reardon, II.
U.S. Pat. No. 4,398,780 issued to Novotny et al,
U.S. Pat. No. 4,453,795 issued to Moulin,
U.S. Pat. No. 4,526,432 issued to Cronin et al, and
U.S. Pat. No. 4,560,232 issued to O'Hara.

Reardon, II shows a basic fold dot connector. Two wafers are pressed together between pressure plates with contact made only by metallic dots or buttons on one of the wafers. The plastic memory of the dots is used as a spring, which is correlated with the force applied by the opposing plates. A similar metallic button connector is disclosed in the Moulin patent.

Cronin et al show an electrical connector including a flat cable which terminates in an end portion configured to fit within the recess of a cylinder. Mounted on the lower surface of the end portion are a plurality of spaced-apart conductor pads. The upper surface of the end portion interfaces with a resilient compression member. The location of pads are complementary to that of conductor pads on bushing.

Novak shows an electrical connector with printed circuit elements. Novotny et al are concerned with a shielded multiconductor cable connector. O'Hara is included for its showing of an electrical feedthru to a high pressure vessel.

Williams et al disclose an electron tube having a hermetic envelope with terminal rings separated by short ceramic cylinders. In this patent, a metal disk is brazed in a cylinder which, in turn, is brazed to another disk. The ceramic cylinders or rings are metalized and brazed to the adjacent metal parts.

While the above-cited references are instructive, a number of prior art techniques have inherent disadvantages. For example, glass feedthru systems are brittle, temperature sensitive, and act as permanent connections. Note that the term "permanent connection" is not meant to be a complementary expression. The word "permanent" is used in the context that the connection is not demountable or changeable.

Glass sealed pin connectors are heat and shock sensitive, and are also permanent connections. Soldered cable connector interfaces are labor intensive permanent connections that are potentially dirty as the flux used remains to contaminate adjacent areas. Similarly, welded wires are labor intensive and permanent connections.

In view of the foregoing discussion, it is apparent that there currently remains the need for a hermetic, vacuum and pressure tight feedthru system. The present invention is intended to satisfy that need.

SUMMARY OF THE INVENTION

The present invention is a leak tight electrical feedthru for vessels which may be evacuated or pressurized relative to the outside ambient. One embodiment of the invention includes a ceramic circuit ring, two sets of gold dot pressure contacts, an annular ceramic seal, and a series of interconnect filaments that electrically connect the two sets of gold dot pressure contacts.

The ceramic circuit ring is concentric with respect to the vessel, and has an inner circumference which is inside the vessel; and an outer circumference which is outside and circumscribes the vessel. The surface of the inner circumference of the ceramic ring has a first set of gold dot pressure contacts which are each electrically connected by one of the interconnect filaments to one of a second set of gold dot pressure contacts.

The second set of gold dot pressure contacts are distributed about the surface of the outer circumference of the ceramic ring. This provides multiple demountable electrical contacts for an outer cable conductor to an inner cable conductor which has multiple demountable electrical contacts with the first set of gold dot pressure contacts.

The gold dot pressure contacts, used with the present invention, are spring-loaded pads which provide demountable electrical contacts. These are disclosed in the Reardon II reference, and are also described in the Moulin reference.

The annular ceramic seal fits between the wall of the vessel and the ceramic circuit ring. This provides a hermetic seal between the inside and the outside of the vessel.

It is an object of the present invention to provide a pressure tight electrical feedthru.

It is another object of the present invention to provide a pressure tight electrical feedthru which has multiple demountable inner electrical contacts which are connected with multiple demountable outer electrical contacts.

It is another object of the invention to provide a means of passing electrical leads through the walls of a vessel in which either a high pressure or a vacuum is maintained.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention is a vacuum tight electrical feedthru, which passes electrical leads through the walls of vessels which have a pressure differential between their interiors and their exteriors.

Figure 1:
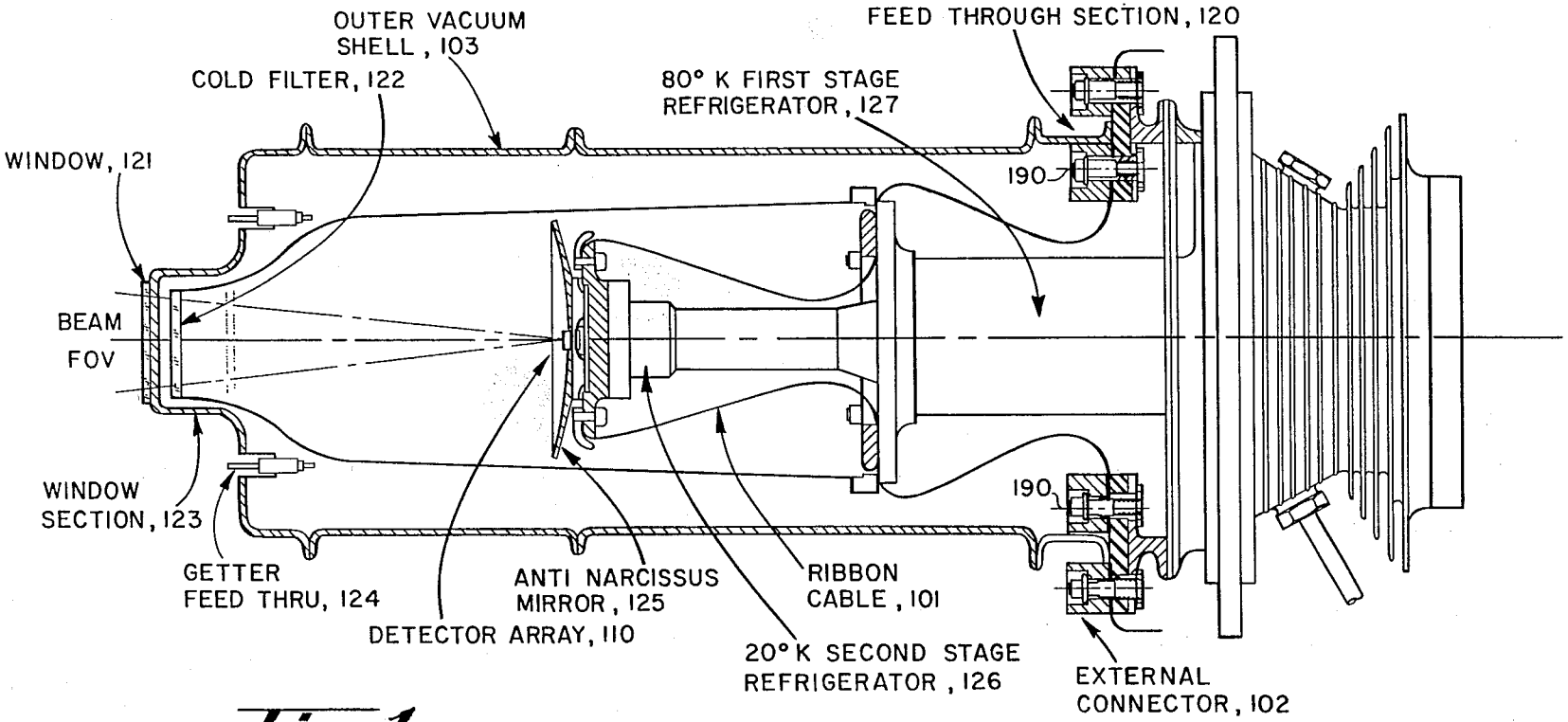
FIG. 1 is an illustration of a system in which the invention may be used.

The reader's attention is now directed towards FIG. 1, which is a side view of an example of a system in which the present invention electrically connects the contacts of a ribbon cable 101 to an external connector 102 which is on the outside of an outer vacuum shell 103.

The example of FIG. 1 is a detector array assembly in which the detector array 110 is housed within a vacuum environment. The feedthru section 120 includes an annular ceramic ring which electrically connects the ribbon cable 101 to an external connector 102 in a manner detailed in a discussion below. Other applications of the present invention include laser systems and infrared sensors which have electrical components housed in a vessel which maintains a pressure differential with respect to the ambient environment.

Figure 2:
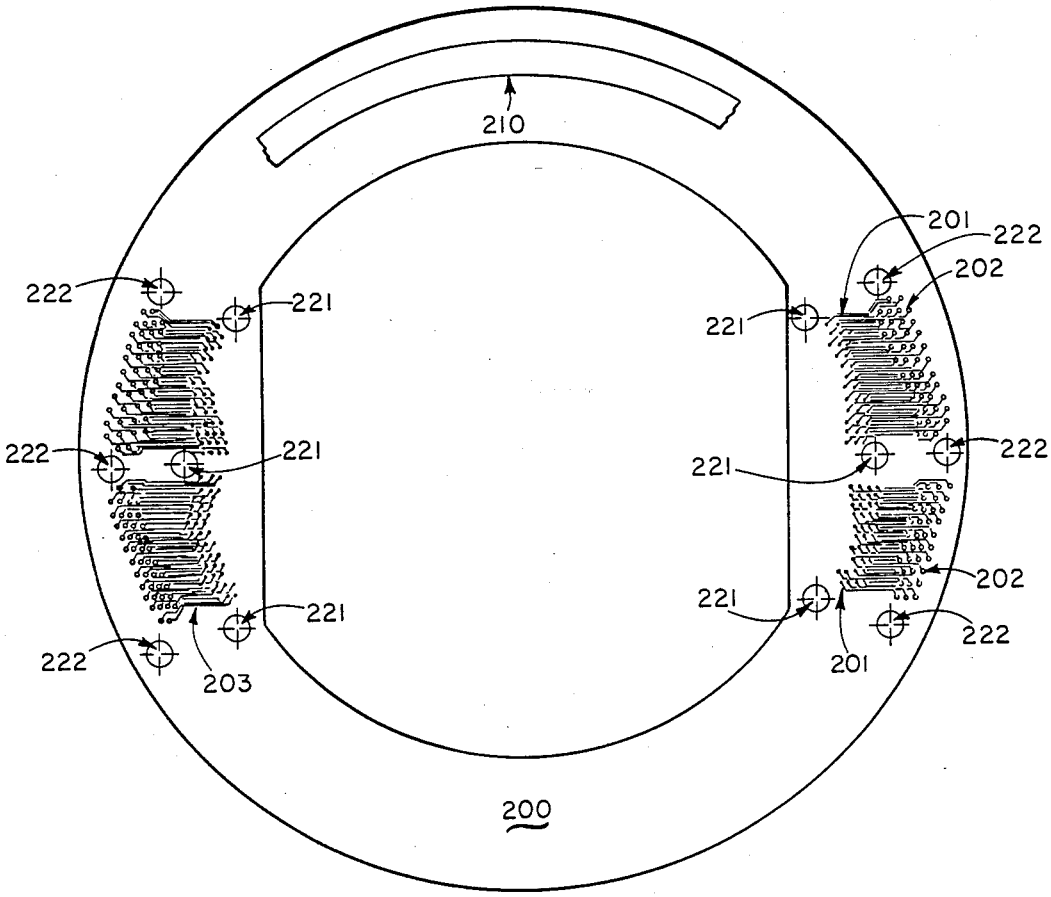
FIGS. 2 and 3 respectively depict an end view and a side view of an embodiment of the invention used in FIG. 1.
Figure 3:
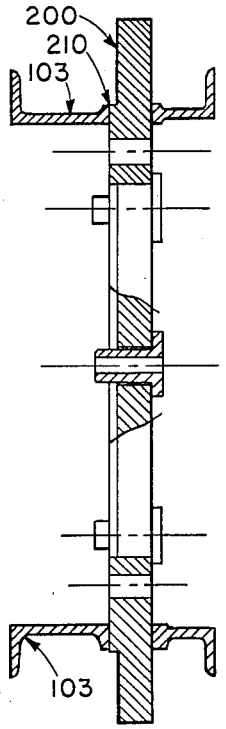

FIGS. 2 and 3 respectively depict an end view and a side view of the invention as used in the system of FIG. 1. The electrical feedthru includes a ceramic circuit ring 200, two sets of gold dot pressure contacts 201, 202, an annular ceramic seal 210, and a series of interconnect filaments 203.

The ceramic circuit ring is concentric with respect to the vessel, and has an inner circumference, which is inside the vessel, and an outer circumference which is outside the vessel. The side view of FIG. 3 clearly depicts the ceramic ring 200 and seal 210 as they abut the walls 103 of the vessel to maintain the pressure differential between the interior and exterior of the vessel.

The reader's attention is now specifically directed toward FIG. 2 which depicts the placement of the two sets of gold dot pressure contacts 201 and 202. The first set of contacts 201 are distributed along the inner circumference of the ceramic circuit ring 200, so that they are within the walls 103 of the vessel. The second set of contacts 202 are distributed along the outer circumference of the ceramic circuit ring 200 so that they are outside the walls 103 of the vessel.

In one embodiment of the invention, the pressure contacts used are the gold dot pressure contacts that were patented in the Reardon II reference. These contacts each provide a demountable connection to either the interior ribbon cable 101 or the external connector 102 depicted in FIG. 1. Each of the first set of gold dot pressure contacts 201 is electrically connected to one of the second set of gold dot pressure contacts 202 by one of the set of filaments 203. This design results in a demountable set of interior electrical connectors which provide electrical leads through the walls 103 of the vessel to a demountable set of exterior electrical connectors 202.

Figure 5:
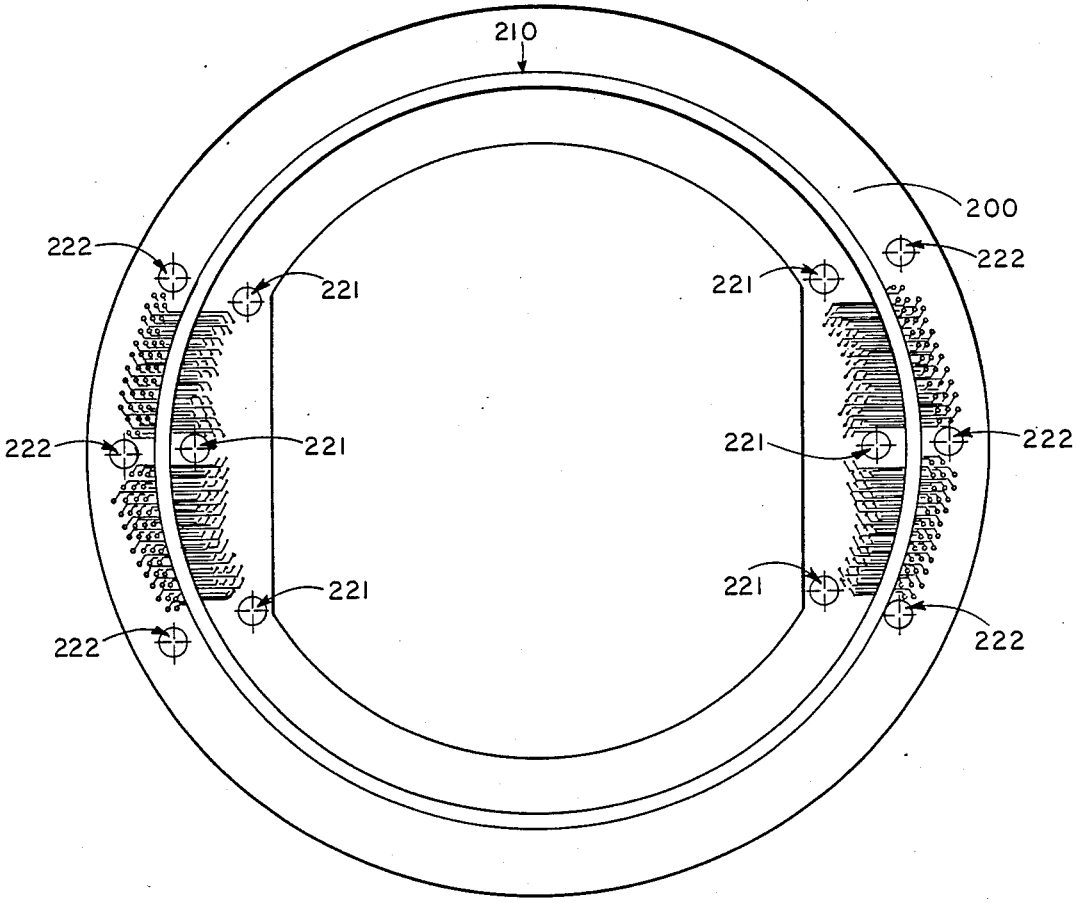
FIG. 5 is an end view of FIG. 2 with the annular ceramic seal depicted as a circular ring which covers the interconnect filaments.

The annular ceramic seal 210 fits between the walls 103 of the vessel and the ceramic ring 20.0-, and covers the filaments 203 as depicted in FIG. 5. This provides a hermetic seal between the inside and the outside of the vessel. Distributed about the ceramic ring circuit are a series of inner and outer apertures 221 and 222. These apertures may be used to allow bolts 190 to tighten the walls of the vessel to form a hermetic filling against the seal. Note that the ceramic ring circuit is formed from conventional ceramic materials, such as those used in the above-cited Williams reference. The use of ceramics allows the individual pressure contacts to be electrically isolated from each other. In this respect, the ceramic ring 200 is similar to a flange which is used to connect two adjacent sections of pipe together, as depicted in U.S. Pat. No. 3,141,686 issued to T. L. Smith et al, the disclosure of which is incorporated herein by reference.

Figure 4:
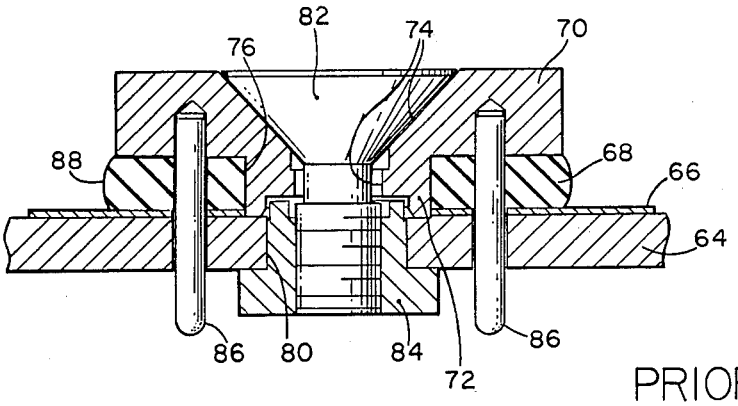
PRIOR ART Fig. 4
FIG. 4 is a prior art pressure contact that may used in the invention of FIG. 2.

The reader's attention is now directed towards FIG. 4, which is a side view of a gold plated copper button pressure contact of the Moulin reference that may be used as one of the two sets of pressure contacts 201 and 202 used in the system of FIG. 2. In FIG. 4, the screw 82 attaches the pressure plate 70 to the printed circuit 64 by compressing the compression pad 68. The result is a demountable electrical contact that may be connected and disconnected as desired.

Note that the pressure contact demountable contacts of the Reardon II and Moulin references are just an example of the type, of contacts thay may be used in the two sets of contacts 201 and 202 distributed about the ceramic ring 200 of FIG. 2. The design of the present invention also allows other conventional electrical fittings to be used in the two sets of contacts 201 and 202. These include plug-and-socket fittings in all their variations. The reason that plug-and-socket fittings can be used is because neither the plug nor the socket is required to be hermetically sealed. The ceramic ring 200, the set filaments 203, and the ceramic seal 210 are the components of the invention that form a hermetic seal with the walls 103 of the vessel.

In the system of FIGS. 1–3 the ceramic ring assembly provides demountabe contacts between the interior and the exterior of a vessel with a pressure differential. The embodiment of the invention depicted in FIG. 2 has the two sets of electrical contacts and connecting filaments on a single side of the ring. In practice, the demountable electrical contacts could be distributed along both sides of the ring. Additionally, the set of connecting filaments 203 could also be actually embedded within the ceramic rather than laying on the surface of the ring. When the filaments do lie on the surface of the ceramic ring 200, the ceramic seal 210 is fired down to the main ceramic ring 200 to form a hermetic seal over the filaments 203.

In another embodiment of the system of FIG. 2, metal rings are brazed onto the ceramic ring 200 to allow the circuit ring to be welded to the housing or walls 103 of the vessel.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. An electrical feedthru for use with a vessel which has walls that maintain a pressure differential in its interior with respect to its ambient environment, said electrical feedthru demountably connecting an interior set of electrical cables to an exterior set of electrical cables while maintaining said pressure differential by avoiding leakage, said electrical feedthru comprising:

a ceramic circuit ring which circumscribes the walls of said vessel, and which has an inner circumference which extends into the interor of said vessel, and an outer circumference which is exterior to said vessel;

a first set of electrical contacts which are distributed about the inner circumference of said ceramic circuit ring, said first set of electrical contacts demountably connecting with said interior set of electrical cables;

a second set of electrical contacts which are distributed about the outer circumference of said ceramic circuit ring, said second set of electrical contacts demountably connecting with said exterior set of electrical cables;

a plurality of filaments which are fixed on said ceramic circuit ring, each of said plurality of filaments electrically connecting one of said first set of electrical contacts with one of said second set of electrical contacts; and a means for hermetically sealing said ceramic circuit ring to the walls of said vessel.

2. An electrical feedthru, as defined in claim 1, wherein said sealing means comprises.

an annular seal which covers said plurality of filaments and fits between said walls of said vessel and said ceramic circuit ring; and a means for fixing said ceramic circuit ring tightly to the walls of said vessel.

3. An electrical feedthru, as defined in claim 2, wherein said ceramic circuit ring has an annular distribution of apertures and which said fixing means comprises a plurality of bolts, each of which project through one of the apertures on said ceramic ring and each of which has threads which when turned pull adjacent wall sections tight against said annular seal.

4. An electrical feedthru, as defined in claim 3, wherein said anular seal is composed of a ceramic ring which has been placed upon said ceramic circuit ring and fixed to hermetically seal said plurality of filaments.

5. An electrical feedthru, as defined in claim 4, wherein said first and second set of electrical contacts each comprise a plurality of gold dot pressure contacts-which are electrically connected with said plurality of filaments, and which demountably connect with said interior set of electrical cables and said exterior set of electrical cables.

6. An electrical feedthru, as defined in claim 2, wherein said fixing means comprises a plurality of metal rings, each of which are brazed to said ceramic circuit ring and welded to said walls of said vessel, said metal rings thereby fixing said walls to said ceramic circuit ring such that said annular seal prevents leakage of said vessel.

7. An electrical feedthrugh, as defined in claim 6, wherein said annular seal is composed of a ceramic ring which has been placed upon said ceramic circuit ring and fired to hermetically seal said plurality of filaments.

* * * * *